United States Patent [19]

Romo

[11] 3,965,344

[45] June 22, 1976

[54] COMPUTER UTILIZING LOGARITHMIC FUNCTION GENERATORS

[75] Inventor: Edgar A. Romo, Costa Mesa, Calif.

[73] Assignee: International Telephone and Telegraph Corporation, New York, N.Y.

[22] Filed: July 24, 1975

[21] Appl. No.: 598,783

[52] U.S. Cl. ..... 235/197; 235/193.5; 328/145

[51] Int. Cl.[2] ..... G06G 7/20; G06G 7/24

[58] Field of Search ..... 235/197, 193, 193.5; 328/145; 307/229; 324/132

[56] References Cited

UNITED STATES PATENTS

| | | | |
|---|---|---|---|
| 3,342,984 | 9/1967 | Gray et al. | 235/193 X |
| 3,439,187 | 4/1969 | Strauss | 235/197 X |
| 3,518,578 | 6/1970 | Oppenheim et al. | 328/145 X |
| 3,657,528 | 4/1972 | Plante | 328/145 X |
| 3,849,706 | 11/1974 | Johnson et al. | 328/145 X |

*Primary Examiner*—Joseph F. Ruggiero
*Attorney, Agent, or Firm*—A. Donald Stolzy

[57] ABSTRACT

Analog apparatus for deriving any root of any input variable directly proportional to an input signal. A second signal directly proportional to the logarithm of the variable is divided in accordance with the root selected. The quotient is then compared by an output circuit with a third signal directly proportional to another logarithm which is a logarithm of a second variable which is, in turn, directly proportional to the output signal. The said output circuit compares the quotient and the third signal as two inputs to the output circuit preferably including a relatively high gain differential amplifier to drive a logarithmic amplifier connected to receive the output signal of the differential amplifier, the logarithmic amplifier being connected as a feedback to one input of the output circuit, the differential amplifier driving the logarithmic amplifier output signal to a point such that the said inputs to the output circuit are effectively equal to each other. The output signal magnitude of the output circuit is then directly proportional to the root of the input signal magnitude.

2 Claims, 4 Drawing Figures

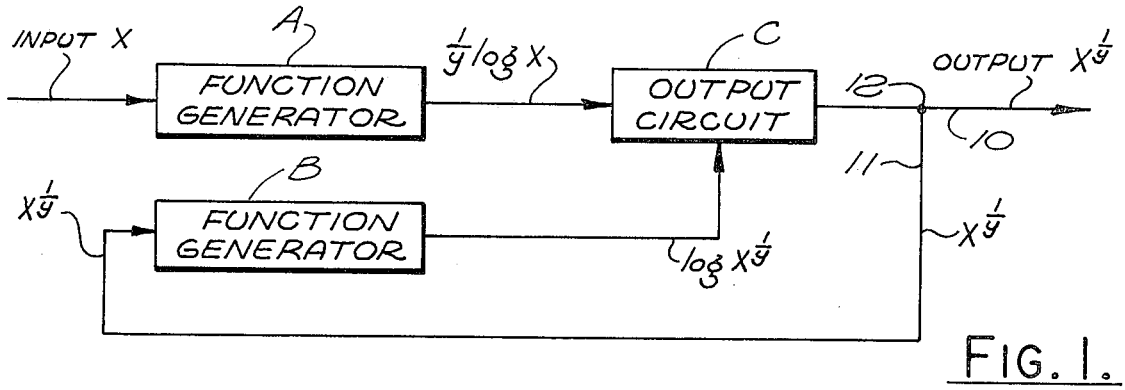
FIG. 1.
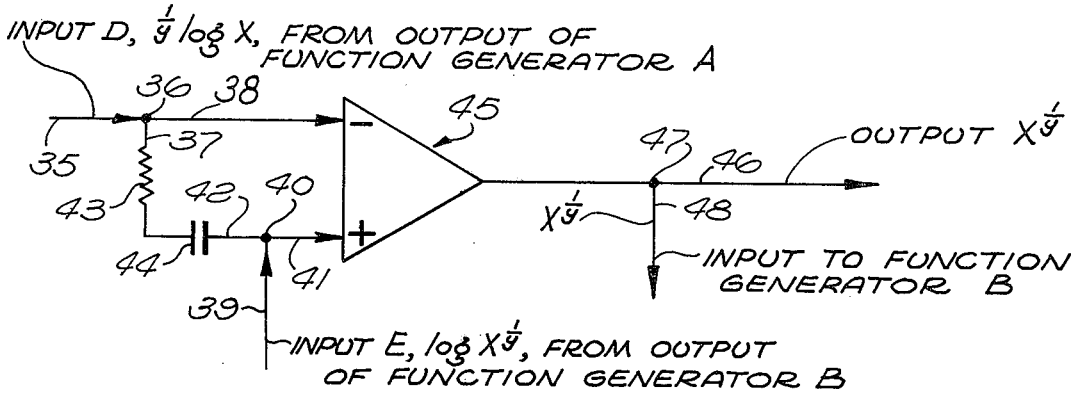
FIG. 4. OUTPUT CIRCUIT C.
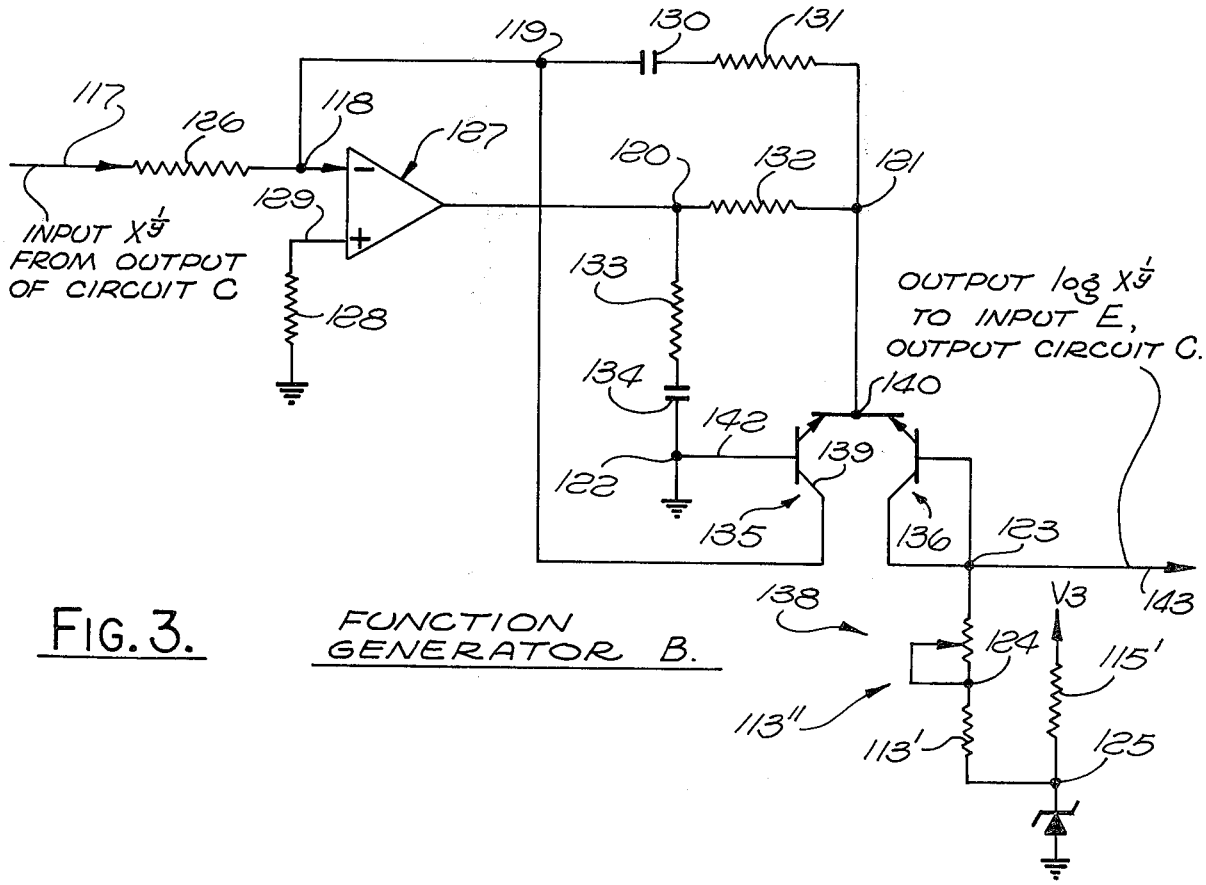
FIG. 3. FUNCTION GENERATOR B.

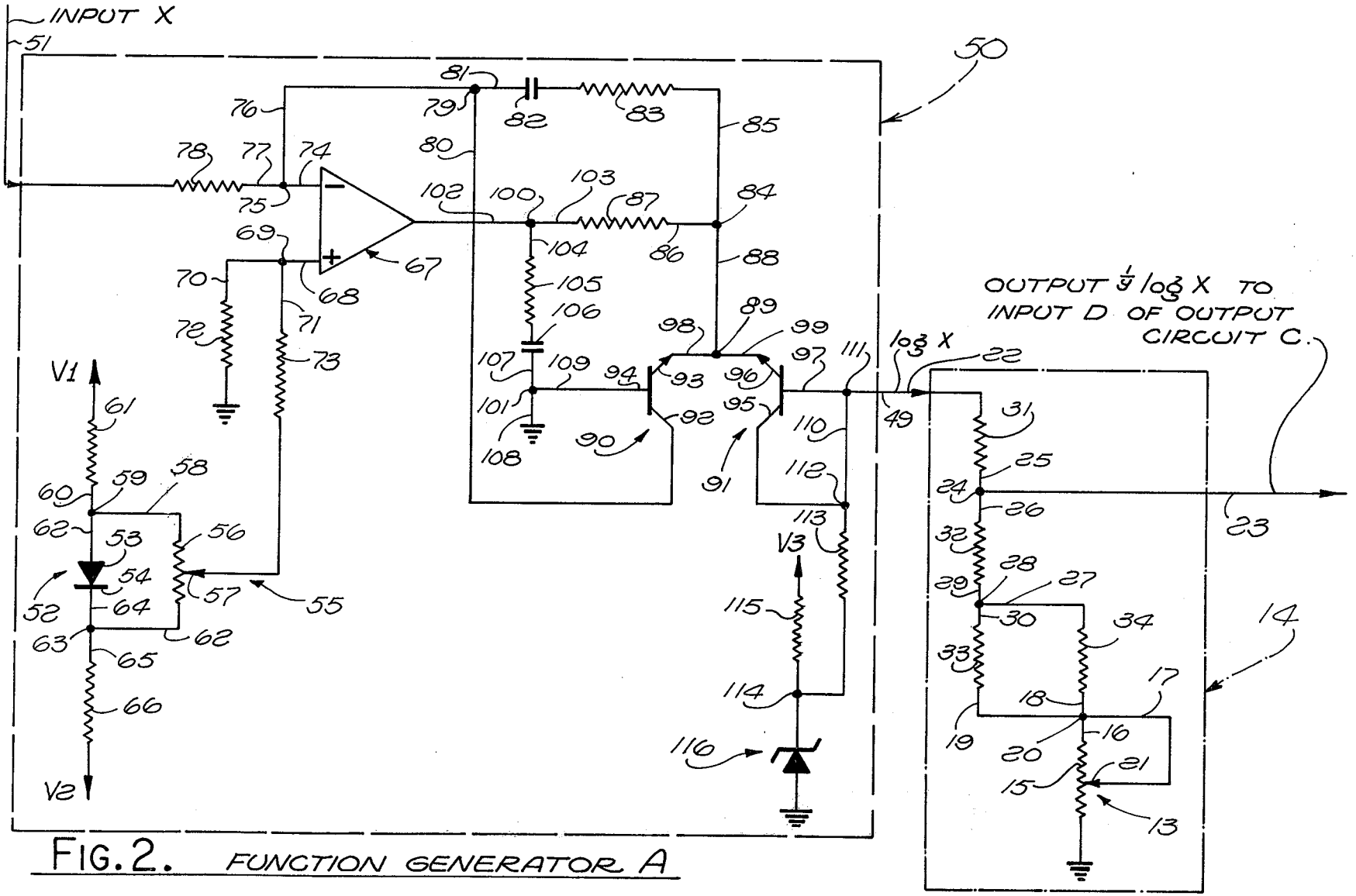
FIG. 2. FUNCTION GENERATOR A

COMPUTER UTILIZING LOGARITHMIC FUNCTION GENERATORS

BACKGROUND OF THE INVENTION

This invention relates to computers, and more particularly to apparatus for producing an output signal magnitude directly proportional to any root of an input signal magnitude.

In the past, several common function generators have produced an output signal magnitude approximating a variable magnitude input signal to, for example, a constant power or root. One such function generator is a biased diode type function generator. Such function generators are piecewise continuous between immediately adjacent pairs of selected points, but the slope of the output signal magnitude versus input signal magnitude curve of these function generators, when graphed, changes abruptly from one constant value to another at each selected point. However, simply by inspection of any function of a variable having a constant exponent greater of less than unity, it will be appreciated that the slope of the function changes gradually and not abruptly. Hence, the biased diode and other point by point methods of simulating a function of a variable with a constant exponent have had large inherent errors. In the past, such errors have been reduced by increasing the number of points and thereby the number of slope changes. However, this procedure results in an extraordinarily large increase in the amount of circuitry required.

SUMMARY OF THE INVENTION

In accordance with the computer of the present invention, the above-described and other disadvantages of the prior art are overcome by providing first and second function generators for receiving, at their inputs, the main input and output signals, respectively. The main input signal magnitude may be directly proportional to, for example, $x$, if desired, where $x$ is a constant of a variable. For $x$, the main output signal magnitude is driven to $x^{1/y}$ in the following way, where $x$ and $y$ are constants or variables in any combination.

The output signal magnitude of the first function generator, when the main input signal magnitude is directly proportional to $x$, is directly proportional to $1/y \log x$.

The output signal magnitude of the second function generator, when the main input signal magnitude is directly proportional to $x$, is then directly proportional to the logarithm of the main output signal magnitude.

In the input $x$ case, an output circuit drives the main output signal magnitude until the output signal magnitudes of both function generators are equal to each other, for example. This makes the main output signal magnitude directly proportional to $x^{1/y}$.

The constant or variable $y$ may be greater or less than unity.

The above-described and other advantages of the present invention will be better understood from the following detailed description when considered in connection with the accompanying drawings.

BRIEF DESCRIPTION OF THE DRAWINGS

In the drawings which are to be regarded as merely illustrative:

FIG. 1 is a block diagram of one embodiment of the present invention;

FIG. 2 is a schematic diagram of a first function generator shown in FIG. 1;

FIG. 3 is a schematic diagram of a second function generator shown in FIG. 1; and FIG. 4 is a schematic diagram of an output circuit shown in FIG. 1.

DESCRIPTION OF THE PREFERRED EMBODIMENT

In FIG. 1, a function generator A and a function generator B have their outputs connected to respective inputs of an output circuit C. The block diagram of FIG. 1 is an analog computer which has an output lead 10. A lead 11 forms a junction 12 with lead 10 connected from the output of output circuit C. Lead 11 provides the input for function generator B. The input to function generator A is the input to the computer. This input is a main input signal which has a magnitude directly proportional to a constant or variable $x$. The output signal magnitude of function generator A is directly proportional to $1/y \log x$, where $y$ may be adjusted in accordance with the position of a wiper on the winding of a potentiometer, to be described, but is then primarily "adjustable" as opposed to being "varied." Notwithstanding the foregoing, $y$ may be a variable. The potentiometer may be operated by a servo mechanism, not shown.

As shown in FIG. 2, function generator A has the input $x$ and this input is impressed upon a logarithmic amplifier 50 having an output at 49. Amplifier 50 has an input lead 51. Amplifier 50 includes a diode 52 having an anode 53 and a cathode 54. Amplifier 50 has a potentiometer 55 with a winding 56 connected in parallel with diode 52. Potentiometer 55 has a wiper 57. Winding 56 has an upper lead 58 forming a junction 59 with a lower lead 60 of resistor 61, and an upper lead 62 connected from the anode 53 of diode 52.

Similarly, the lower end of potentiometer winding 56 has a lead 62 which forms a junction 63 with a lead 64 from diode cathode 54 and an upper lead 65 of a resistor 66. The upper end of resistor 61 is connected to potential V1. The lower end of resistor 66 is connected to potential V2. Amplifier 50 includes a differential amplifier 67 having a noninverting input lead 68 which forms a junction 69 with upper leads 70 and 71 of resistors 72 and 73, respectively. The lower end of resistor 72 is grounded. The lower end of resistor 73 is connected to potentiometer wiper 57.

Amplifier 67 also has an inverting lead 74 forming a junction 75 with a feedback lead 76 and a lead 77. A resistor 78 is connected between the input lead 51 of amplifier 50 and lead 77.

Lead 76 forms a junction 79 with a lead 80 and a lead 81. A capacitor 82 and a resistor 83 are provided. Capacitor 82 and resistor 83 are connected from junction 79 to junction 84 in succession in series in that order, junction 84 being formed by a lead 85 connected from the right end of potentiometer 83, a lead 86 connected from the right end of a resistor 87, and a lead 88 connected from a junction 89.

Transistors are provided at 90 and 91. Transistor 90 has a collector 92, an emitter 93 and a base 94. Transistor 91 has a collector 95, an emitter 96 and a base 97. Emitter 93 and 96 are connected via leads 98 and 99 to lead 88, forming junction 89. Junctions are formed at 100 and 101. Junction 100 is formed by an output lead 102 of amplifier 67, the left-hand lead 103 of resistor 87, and the upper lead 104 of a resistor 105. A capacitor 106 is also provided. Resistor 105 and capacitor 106 are connected from junction 100 to junction 101 in succession in series in that order. Junction 101 is grounded. Junction 101 is formed by a lower lead 107 of capacitor 106, a ground lead 108, and a lead 109 connected from transistor base 94. A lead 110 connects junctions 111 and 112. Transistor base 97 is connected to junction 111. The output lead 49 of amplifier 50 is connected from junction 111. Transistor collector 95 is connected to junction 112. A resistor 113 is connected from junction 112 to a junction 114. A resistor 115 is connected from a potential V3 to junction 114. A zener diode 116 is connected from junction 114 to ground.

In FIG. 2, a voltage divider 14 is provided having an input lead 22 connected from output lead 49 of logarithmic amplifier 50. Potentiometer 13 is the aforesaid potentiometer which determines the magnitude of *y*. Potentiometer 13 has a winding 15, the lower end of which is grounded, and the upper end of which is connected to a lead 16 that forms a junction 20 with leads 17, 18 and 19. Potentiometer 13 has a wiper 21 which is connected to lead 17. Voltage divider 14 has an input lead 22 and an output lead 23. Output lead 23 forms a junction 24 with leads 25 and 26. A lead 27 forms a junction 28 with a lead 29 and a lead 30. A resistor 31 is connected between leads 22 and 25. A resistor 32 is connected between leads 26 and 29. A resistor 33 is connected between leads 30 and 19. A resistor 34 is connected between leads 27 and 18. Voltage divider 14 may be entirely conventional, if desired.

Function generator B is shown in FIG. 3. Function generator B and logarithmic amplifier 50 each may be an entirely conventional logarithmic amplifier, if desired. In FIG. 3, function generator B includes an input lead 117, and junctions 118, 119, 120, 121, 122, 123, 124 and 125. A resistor 126 is connected from input lead 117 to junction 118. Junctions 118 and 119 are connected together, and to an inverting input lead of a differential amplifier 127. A resistor 128 is connected from the non-inverting input lead 129 of amplifier 127 to ground. A capacitor 130 and a resistor 131 are connected in succession in series in that order from junction 119 to junction 121. A resistor 132 is connected between junctions 120 and 121. The output of amplifier 127 is connected to junction 120. A resistor 133 and a capacitor 134 are connected in succession in series in that order from junction 120 to junction 122. Junction 122 is grounded as before. Transistors 135 and 136 with the circuitry 137 shown therebelow is identical to the transistors 90 and 91 and circuitry 138 shown therebelow in FIG. 2. The connections thereof are also identical. The same therefore will not be described in detail, transistor 135 having a collector 139 connected from junction 119, a junction 140 from the transistor emitters being connected from junction 121 via a lead 141, and transistor 135 having a base 142 connected from junction 122. Function generator B thus has an output lead 143.

Output circuit C is shown in FIG. 4 having a first input lead 35 forming a junction 36 with a lead 37 and a lead 38. Output circuit C has a second input lead 39 which forms a junction 40 with a lead 41 and a lead 42.

A resistor 43 and a capacitor 44 are connected in succession in that order in series from lead 37 to lead 42. Lead 38 is connected to the inverting input of a high gain (100,000 to 500,000, for example) amplifier 45. Lead 41 is connected to the non-inverting input of amplifier 45. The output of amplifier 45 is indicated at 46 and forms a junction 47 with an output lead 48.

The first input 35 of output circuit C shown in FIG. 4 is connected from the output of function generator A shown in FIG. 1. The second input 39 of output circuit C shown in FIG. 4 is connected from the output of function generator B shown in FIG. 1.

The output of amplifier 45 is the main output and is directly proportional to $x^{1/y}$. Lead 46 carries the output signal of the computer of FIG. 1 which has a magnitude directly proportional to $x^{1/y}$.

OPERATION

In the operation of the embodiment illustrated in FIG. 1, the magnitude of *y* can be adjusted by adjusting the position of wiper 21 on potentiometer 13. The output of function generator A which is thus impressed upon output circuit C is 1/y log *x*.

Output circuit C shown in FIG. 4 may otherwise be a conventional differential amplifier, if desired. At any rate, it may have a gain of, for example, 100,000 to 500,000. It will thus drive the input of function generator B until the input of input lead 39 shown in FIG. 4 from the output of function generator B is equal to the potential on the inverting input lead 38 of differential amplifier 45 shown in FIG. 4. The difference will be insignificant due to the large gain of amplifier 45. When this is true, the output of function generator B will then be log $x^{1/y}$. Thus, if the immediately preceding expression defines the output of function generator B, the output signal magnitude of output circuit C must then be directly proportional to the antilog of the output signal magnitude of the function generator B. The output signal of output circuit C then appears on output lead 10 thereof as shown in FIG. 1. The output signal magnitude of output circuit C is then $x^{1/y}$.

Typical circuit values for FIGS. 2, 3 and 4 are as follows; however, these circuit values are by no means critical.

| | |
|---|---|
| Capacitor 44 | 0.0068 microfarads |
| Capacitor 82 | 0.03 microfarads |
| Capacitor 106 | 0.33 microfarads |
| Capacitor 130 | 0.03 microfarads |
| Capacitor 134 | 0.33 microfarads |
| Diode 52 | 1N914 |
| Diode 116 | 1N4566 |
| Potentiometer 13 | 10,000 ohms |
| Potentiometer 55 | 1,000 ohms |
| Potentiometer 113" | 10,000 ohms |
| Resistor 31 | 20,000 ohms |
| Resistor 32 | 15,000 ohms |
| Resistor 43 | 9,090 ohms |
| Resistor 61 | 20,000 ohms |
| Resistor 66 | 20,000 ohms |
| Resistor 72 | 499 ohms |
| Resistor 78 | 10,000 ohms |
| Resistor 83 | 499 ohms |
| Resistor 87 | 1,000 ohms |
| Resistor 105 | 301 ohms |
| Resistor 113 | 90,900 ohms |
| Resistor 113' | 66,500 ohms |
| Resistor 115 | 3,010 ohms |
| Resistor 115' | 3,010 ohms |
| Resistor 126 | 10,000 ohms |
| Resistor 128 | 499 ohms |
| Resistor 131 | 499 ohms |
| Resistor 132 | 1,000 ohms |
| Resistor 133 | 301 ohms |
| Twin Transistors 90 and 91 | TD100 |
| Twin Transistors 135 and 136 | TD100 |

Both $x$ and $y$ may be variable, $x$ may be constant and $y$ may be variable, $x$ may be variable and $y$ may be constant, or both $x$ and $y$ may be constant.

The embodiment of the invention disclosed hereinbefore may be described as a computer responsive to a main input signal directly proportional to $x$. The variable $x$ may be described as a "first function." The computer of the invention is provided to produce a main output signal of a magnitude directly proportional to $x^{1/y}$. The term $y$ may be described as a "third function."

Function generator A may be described as a "first function" generator.

What is claimed is:

1. A computer responsive to a main input signal directly proportional to a first function $x$ for producing a main output signal of a magnitude directly proportional to a second function $x^{1/y}$, where $y$ is a third function, said computer comprising: a first function generator having an output and being responsive to said main input signal for producing a first output signal at said output thereof directly proportional to 1/y log x; an output circuit having first and second inputs and an output; and a second function generator having an input connected from said output circuit output, said second function generator output being connected to said output circuit second input, said output circuit first input being connected from said first function generator output, said output circuit being constructed to produce a main output signal at said output of said output circuit, said second function generator producing a second output signal at said output thereof directly proportional to the logarithm to the same base as that of said log x of said output circuit main output signal, said output circuit being constructed to drive said main output signal to a magnitude such that said second output signal becomes equal in magnitude to that of said first output signal.

2. The invention as defined in claim 1, wherein said first function generator includes a first logarithmic amplifier having an input to receive said main input signal, said first logarithmic amplifier also having an output, said first function generator having a voltage divider connected from said first logarithmic amplifier output to said output circuit first input, said output circuit including a differential amplifier having an inverting input connected from said voltage divider, said differential amplifier also having a non-inverting input and an output, said non-inverting input being connected from the output of said second function generator input, said differential amplifier output being connected to said second function generator input, said second function generator including a second logarithmic amplifier having an input and an output connected respectively to the input and output of said second function generator.

* * * * *